United States Patent [19]

Anderson

[11] Patent Number: 4,848,736

[45] Date of Patent: Jul. 18, 1989

[54] HAND POWERED TOY VEHICLE

[75] Inventor: Wilford A. Anderson, Robbinsdale, Minn.

[73] Assignee: Wilfred G. Nye, Minneapolis, Minn.; a part interest

[21] Appl. No.: 176,168

[22] Filed: Mar. 31, 1988

[51] Int. Cl.[4] ..... A63G 1/12

[52] U.S. Cl. ..... 272/33 R; 272/44; 104/53; 105/87; 280/244; 280/252

[58] Field of Search ..... 272/33 R, 34 A, 33 B, 272/30, 39, 43, 44; 105/86, 87, 88, 93; 280/243, 244, 252, 253, 254; 104/53, 58, 60–62, 79–81, 85, 164

[56] References Cited

U.S. PATENT DOCUMENTS

| | | | |
|---|---|---|---|
| 153,023 | 7/1874 | Spencer . | |
| 189,010 | 4/1877 | Artley et al. . | |
| 293,837 | 2/1884 | Woodruff | 280/243 X |
| 327,303 | 9/1885 | Page . | |
| 356,542 | 1/1887 | McCabe . | |
| 644,805 | 3/1900 | McGee . | |
| 645,364 | 3/1900 | Kresen et al. . | |
| 819,580 | 5/1906 | McKinney . | |
| 822,876 | 6/1906 | Ware et al. . | |
| 1,065,783 | 6/1913 | Crowe . | |
| 1,112,216 | 9/1914 | Keller | 105/87 X |
| 1,368,696 | 2/1921 | Butterfield . | |
| 1,457,035 | 5/1923 | Kotlik | 272/43 |
| 1,607,250 | 11/1926 | Dyer | 280/243 X |
| 1,791,678 | 2/1931 | McClellan . | |
| 1,798,098 | 3/1931 | Miller . | |
| 1,914,451 | 6/1933 | Needham . | |
| 2,073,383 | 3/1937 | Allen . | |
| 2,457,355 | 12/1948 | Dittmar . | |
| 2,533,368 | 12/1950 | Hansen et al. . | |
| 2,638,345 | 5/1953 | Norvell . | |
| 3,642,275 | 2/1972 | Ellico . | |

*Primary Examiner*—David A. Scherbel
*Assistant Examiner*—Richard E. Chilcot, Jr.
*Attorney, Agent, or Firm*—Palmatier & Sjoquist

[57] ABSTRACT

The present invention is a toy vehicle upon which a child may ride and propel the vehicle forwardly by merely oscillating a swingable lever. The toy vehicle incorporates a drive operated by oscillating a swingable lever, and wherein forward propulsion is applied to the drive wheel by swinging the lever in both directions as the lever is being oscillated. The swingable oscillatable lever rotatably oscillates a drive pulley connected to an endless belt. When turned in one direction, the pulley tightens and drives the somewhat slack belt and propels the drive wheel forwardly. When the pulley is turned in the other direction, the pulley again tightens the belt and again propels the drive wheel forwardly.

16 Claims, 2 Drawing Sheets

HAND POWERED TOY VEHICLE

BACKGROUND OF THE INVENTION

1. Field of the Invention

The present invention relates to toy vehicles and, more particularly, to hand powered toy vehicles with pulley and belt drives.

2. Description of the Prior Art.

The prior art includes toy cars having pedals and gears. A toy car may be propelled by pedals connected to the front wheels or by pedals located in the front of the toy vehicle but driving the rear wheels by a set of gears. A toy car propelled by such a gear mechanism may be expensive and excessively complicated.

For a young child, a toy vehicle with pedals may be difficult to operate and control. Operation of a toy vehicle as such requires coordination of the feet for peddling, and hand-eye coordination for steering purposes. Initiation of a frontwardly peddling motion may be especially difficult for a child. Furthermore, the feet and hands of a child may need to be coordinated to operate the toy vehicle safely or the toy vehicle may meander dangerously out of control.

SUMMARY OF THE INVENTION

A feature of the present invention is a toy vehicle upon which a child may ride and propel the vehicle forwardly by merely oscillating a swingable lever.

Another feature of the present invention is a toy vehicle incorporating a drive operated by oscillating a swingable lever, and wherein forward propulsion is applied to the drive wheel by swinging the lever in both directions as the lever is being oscillated.

A further feature of the present invention is a toy vehicle with a drive utilizing a swingable oscillatable lever which rotatably oscillates a drive pulley connected to an endless belt. When turned in one direction, the pulley tightens and drives a somewhat slack belt and propels the drive wheel forwardly. When the pulley is turned in the other direction, the pulley again tightens the belt and again propels the drive wheel forwardly.

An advantage of the present invention is its simplicity of operation. The operator of the toy vehicle, typically a child, propels the vehicle forwardly by merely oscillating a swingable lever.

Another advantage of the present invention is that it is safe. The drive means is enclosed within the toy vehicle's housing. Furthermore, there is no need for gears or complicated mechanisms.

A further advantage of the present invention is that the toy vehicle is propelled forwardly regardless of the direction of movement of the oscillating lever.

A still further advantage of the present invention is that the endless belt, drive pulley and drive wheel have no dead spots or over center positions, unlike a Pitman oscillator.

DETAILED DESCRIPTION OF THE PREFERRED EMBODIMENTS

Figure 1:
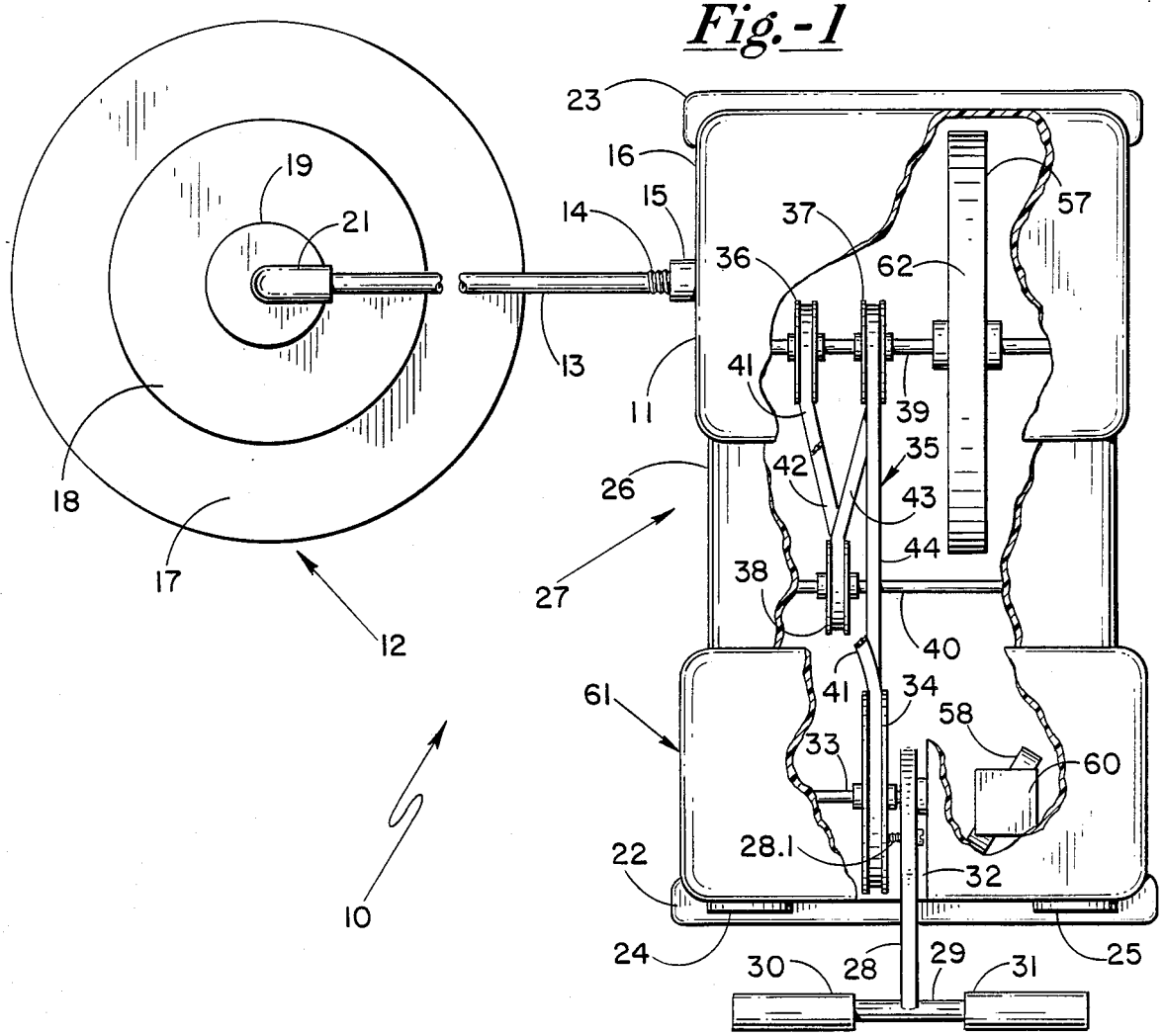
FIG. 1 is a top plan view of the toy vehicle partially broken away for clarity of detail.
Figure 2:
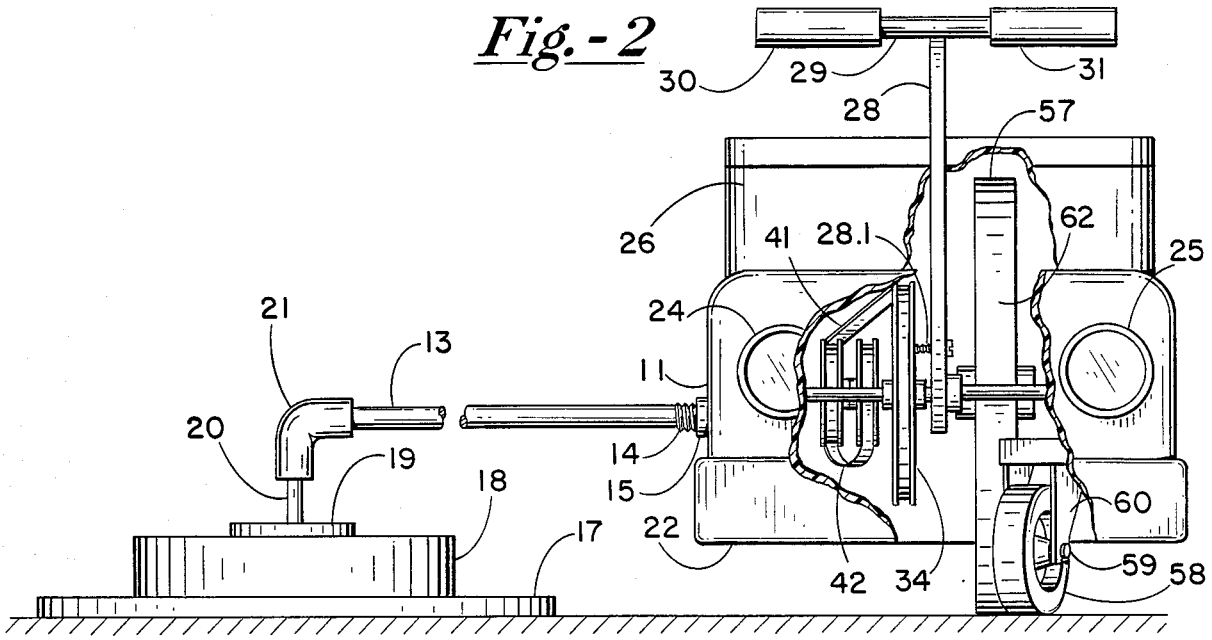
FIG. 2 is an elevational view of the toy vehicle shown in FIG. 1 and partially broken away for clarity of detail.

As shown in FIGS. 1 and 2, a toy vehicle 10 having a housing 11 is connected to a support platform or base 12 by a removable support rod 13 with mounting threads 14. A threaded mount 15 is connected to an inside section 16 of the housing 11 and receives and cooperates with the threads 14 of the rod 13.

The base 12 has three rounded sections 17, 18, and 19 an d a vertical rotor rod 20 extending upwardly from hub 19 with an internal bearing for rotor rod 20. A pivot joint 21 is pivotally connected to the vertical rod 20 and fixedly connected to the support rod 13 so that rod 13 is substantially perpendicular to rod 20.

The vehicle housing 11 has a front bumper 22, a rear bumper 23, and a pair of front headlights 24 and 25. An operator seat 26 is formed by the housing 11 near a middle section 27 of the toy vehicle 10.

A manually operable oscillating lever 28 having an operator handle 29 with a pair of hand grips 30 and 31 extends from the exterior to the interior of the housing 11 through an opening 32 formed in the housing 11. The lever 28 having a screw 28.1 is connected to a rotatable shaft 33 which is maintained in bearings suitable affixed to the housing 11 and fixedly connected to a drive or driving V-pulley or drive means 34. The screw 28.1 may be affixed to the pulley 34 to augment the connection between the pulley 34 and the lever 28.

The pulley 34 has an endless belt or flexible element or drive means 35 trained thereover. The belt 35 is further trained over a set of driven V-pulleys or drive means 36 and 37, and an idler V-pulley or drive means 38. The driven pulleys 36 and 37 are affixed or keyed to a rotatable drive shaft 39 which is mounted in bearings suitably affixed to the housing 11 rearwardly of and substantially parallel to the shaft 33. The idler pulley 38 is rotatable and connected to a shaft 40 which is mounted in bearings suitably affixed to the middle section 27 of housing 11 between and parallel to shafts 33 and 39. The pulleys 34, 36, 37, and 38 are rotatable but are stationary against movement transversely of the rotation axes.

Figure 3:
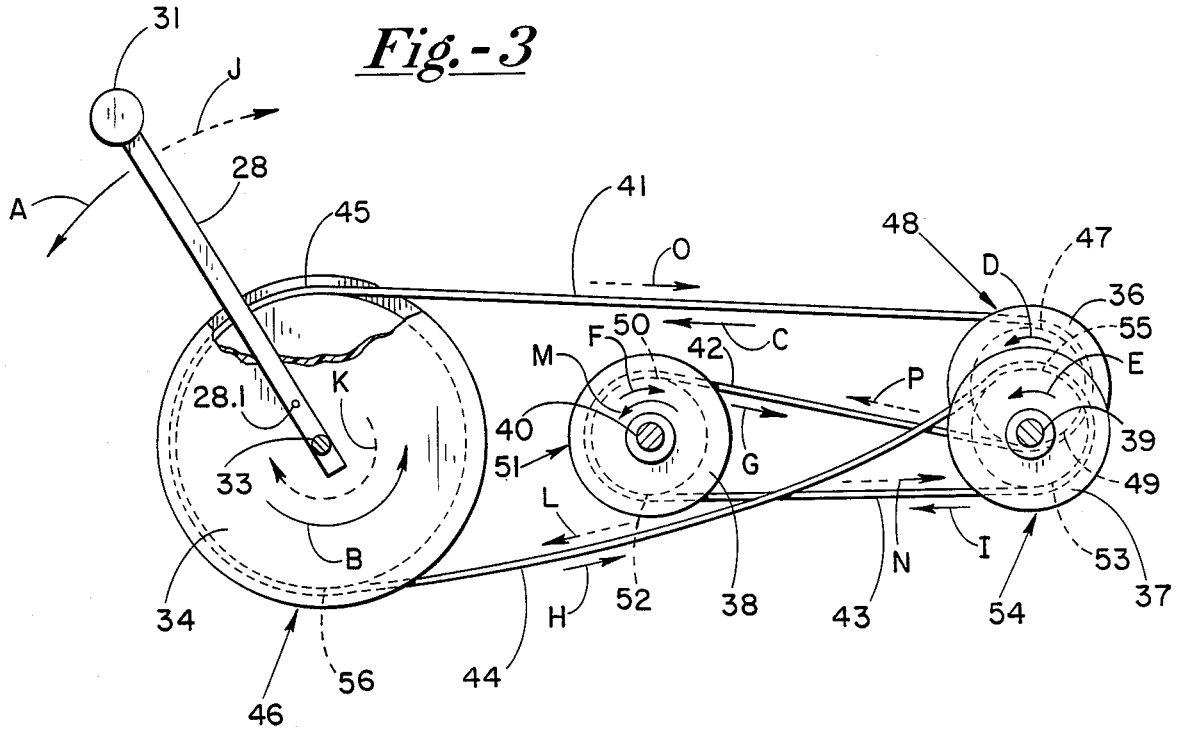
FIG. 3 is a diagrammatic view illustrating the drive system for the toy vehicle shown in FIG. 1.

As shown in FIGS. 1, 2, and 3, the endless belt 35 has a set of four runs 41, 42, 43, and 44 among the four pulleys 34, 36, 37, and 38. The run 41 extends from a top 45 of a bight 46 of the belt 35 on pulley 34 to a top 47 of bight 48 of the belt 35 on the pulley 36. The run 42 extends from a bottom 49 of bight 48 to a top 50 of a bight 51 of the belt 35 with the pulley 38. The run 43 extends from a bottom 52 of a bight 51 to a bottom 53 of a bight 54 of belt 35 with pulley 37. The run 44 extends from a top 55 of the bight 54 to a bottom 56 of the bight 46 of belt 35 with pulley 34. Slack is produced in belt run 44 and bight 54 when belt run 41 is tightened. Slack is produced in belt run 41 and bight 48 when belt run 44 is tightened.

Driving pulley 34 is aligned longitudinally with driven pulley 37. Driven pulley 36 is misaligned with or offset longitudinally from driving pulley 34. Idler pulley 38 is misaligned longitudinally with each driven pulley 36 and 37.

As shown in FIGS. 1 and 2, a support drive wheel 57 is affixed or keyed to the rotatable shaft 39 which is mounted in bearings suitably affixed to the housing 11.

A guide wheel 58 is affixed or keyed to a rotatable shaft 59 which is mounted in bearings suitably affixed to a shaft mount 60. The mount 60 is connected to a front section 61 of the vehicle housing 11. The guide wheel 58 is turned inwardly to guide the toy vehicle 10 around the base 12. A rim 62 of drive wheel 57 and a rim 63 of guide wheel 58 may be flat and have a rubberized tread to grip the surface on which the toy vehicle 10 is to be driven.

In operation, as the lever 38 is moved in the forwardly direction of arrow A, pulley 34 rotates in the forwardly direction of arrow B to tighten belt run 41 and drive belt run 41 in the forwardly direction of arrow C. Pulley 36 is thereby driven to rotate in the forwardly direction of arrow D by belt run 41 running in the forwardly direction of arrow C. As pulley 36 rotates forwardly, it drives shaft 39 and pulley 37 in the forwardly direction of arrow E. Simultaneously as the lever 28 is moved forwardly, belt run 44 is loosened to produce slack therein and a belt slippage of bight 54 on pulley 37. The belt slippage on pulley 37 permits pulley 38 to be driven in the rearwardly direction of arrow F by belt run 42, which is driven in the rearwardly direction of arrow G by pulley 36. As belt slippage occurs on pulley 37, belt run 44 may move in the rearwardly direction of arrow H and belt run 43 may move in the forwardly direction of arrow I. As belt 35 slips or is loosened about pulley 37 and bight 54, belt run 41 is tightened and belt 35 is tightened about pulley 36 and bight 48 to transmit a driving force through the belt 35 and apply a driving torque to the drive wheel 57 in the direction of forward rotation.

As the lever 28 is moved in the rearwardly direction of arrow J, pulley 34 rotates in the rearwardly direction of arrow K to tighten belt run 44 and drive belt run 44 in the forwardly direction of arrow L. Pulley 37 is thereby driven to rotate in the forwardly direction of arrow E by belt run 44 running in the forwardly direction of arrow L. As pulley 37 rotates forwardly, it drives shaft 39 in the forwardly direction of arrow E and pulley 36 in the forwardly direction of arrow D. Simultaneously as the lever 28 is moved rearwardly, belt run 41 is loosened to produce slack therein and a belt slippage of bight 48 on pulley 36. The belt slippage on pulley 36 permits pulley 38 to be driven in the forwardly direction of arrow M by belt run 43, which is driven in the rearwardly direction of arrow N by pulley 37. As belt slippage occurs on pulley 36, belt run 41 may move in the rearwardly direction of arrow 0 and belt run 42 may move in the forwardly direction of arrow P. As belt 35 slips or is loosened about pulley 36 and bight 48, belt run 44 is tightened and belt 35 is tightened about pulley 37 and bight 54 to transmit a driving torque to the drive wheel 57 in the direction of forward rotation.

Therefore, as the lever 28 is swingably oscillated, the drive wheel 57 is continuously being driven and rotated in the forwardly direction as the belt 35 is alternatively tightened and loosened about pulleys 36 and 37. Thus, the toy vehicle is propelled forwardly and continuously in a circle about the support platform.

Figure 4:
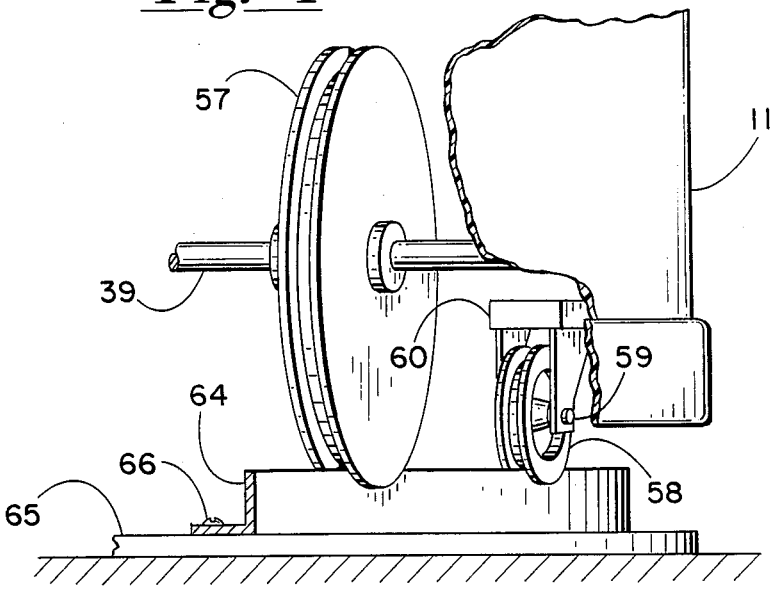
FIG. 4 shows a modified form of the invention and is a detailed sectional view through the supporting base and track.

In an alternate embodiment, as shown by FIG. 4, the drive wheel 57 and the guide wheel 58 are V-pulleys cooperating with and driven on a circular flanged guide track 64 of angle iron. The track 64 may be connected to a platform 65 by a plurality of bolts 66. Platform 65 may extend from and be connected to base 12.

THAT WHICH IS CLAIMED:

1. A toy vehicle comprising a vehicle housing having a seat, a plurality of support wheels connected to said vehicle housing, one of said wheels being a drive wheel to be rotated forwardly to propel the vehicle forwardly, a manually operated lever swingably mounted on said vehicle housing for swinging oscillation, and drive means between said drive wheel and lever and rotating said drive wheel forwardly in both directions of oscillatory movement of said lever whereby the toy vehicle is propelled forwardly.

2. The apparatus of claim 1 wherein said drive means includes a belt, said drive means alternately tightening and loosening said belt and simultaneously alternating portions of said belt applying driving torque to the drive wheel in the direction of forward rotation.

3. The apparatus of claim 2 wherein said drive means includes a plurality of pulleys about which the belt is trained, said pulleys being rotatable but stationary against movement transversely of the rotation axes.

4. The apparatus of claim 2 wherein said drive means includes a rotatably oscillatable drive pulley connected with said lever, said belt being trained over said drive pulley and having a pair of belt runs extending from said drive pulley, said drive means alternately tightening said runs for transmitting driving force therethrough for applying said driving torque to said drive wheel.

5. The apparatus of claim 1 further comprising a support base having a pivoting support rod connected to said vehicle housing, said vehicle being urged by said drive wheel about said support base.

6. The apparatus of claim 5 wherein said support base includes a guide track with which at least two of said support wheels cooperate.

7. The apparatus of claim 5 wherein said support wheels include pulleys.

8. The apparatus of claim 5 wherein one of said support wheels is a guide wheel for guiding said toy vehicle about said support platform.

9. The apparatus of claim 5 wherein said pivoting support rod is removably connected to said vehicle housing.

10. A hand powered toy vehicle comprising a vehicle housing, guide means connected to said vehicle housing for guiding said vehicle, a drive wheel connected to said vehicle housing for urging said vehicle in a first direction, said drive wheel being rotatable in a first rotary direction, a first pulley connected to said vehicle housing and rotatable in the first rotary direction and a second rotary direction, a pair of second and third pulleys connected to said drive wheel in driving relation and rotatable in the first direction with the drive wheel, a fourth pulley connected to said vehicle housing and rotatable in the first and second rotary directions, oscillating means connected to said first pulley for rotating said first pulley in the first and second rotary directions, and an endless drive belt connected to and cooperating among said pulleys, said second pulley being driven by said belt and rotating said drive wheel in the first rotary direction when said first pulley is rotated in the first rotary direction, said third pulley being driven by said belt and rotating said drive wheel in the first rotary direction when said first pulley is rotated in the second rotary direction, said fourth pulley being driven by said belt in the first and second rotary directions when said first pulley is rotated in the second and first rotary directions respectively, said belt slipping on said third pulley and tightening about said second pulley when said first pulley rotates in the first rotary direction, said belt slipping on said second pulley and tightening about said third pulley when said first pulley rotates in the second rotatry direction whereby said first vehicle is urged in a first direction regardless of whether said oscillating means rotates said first pulley in the first or second rotary direction.

11. The apparatus of claim 10 wherein said oscillating means includes a lever.

12. The apparatus of claim 10 wherein said guide means includes a guide wheel.

13. The apparatus of claim 10 further comprising a support base having a pivoting support rod connected to said vehicle housing, said vehicle being urged by said drive wheel about said support base.

14. The apparatus of claim 13 wherein said support base includes a guide track.

15. The apparatus of claim 14 wherein said guide means and drive wheel include V-pulleys for operating on said guide track.

16. A hand powered toy vehicle comprising a vehicle housing, means supporting and controlling steerage of travel of the housing and including a drive wheel mounted on said vehicle housing for propelling said vehicle forwardly, said drive wheel being rotatable forwardly, a driving pulley journalled on said vehicle housing and rotatable first and second rotary directions;

a pair of driven pulleys affixed to said drive wheel in driving relation and rotatable forwardly therewith, an idler pulley journalled on said vehicle housing, lever means connected to said driving pulley for oscillating said driving pulley, and an endless belt trained over the driving pulley and extending in separate driving runs to and around the two driven pulleys respectively, and then extending to and around the idler pulley, said driving runs alternately being moved forwardly as the driving pulley is oscillated, the driving runs being oppositely trained around the driven pulleys so that each of the driving runs produces forward rotation of the respective driven pulley as the driving run moves forwardly, the belt having sufficient slack as to slip over one of the driven pulleys during each opposite rotation movements of the driving pulley, the alternate forward movements of each run producing tensioning of the run and driving of the respective driven pulley over which the forwardly moving run is trained, whereby to produce forward rotation of the drive wheel as the lever means is oscillated.

* * * * *